US008794914B2

(12) United States Patent
Hommes et al.

(10) Patent No.: US 8,794,914 B2
(45) Date of Patent: Aug. 5, 2014

(54) COMPOSITE CENTRIFUGAL COMPRESSOR WHEEL

(75) Inventors: Daniel J. Hommes, Metamora, MI (US); Carnell E. Williams, Southfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 700 days.

(21) Appl. No.: 12/952,763

(22) Filed: Nov. 23, 2010

(65) Prior Publication Data

US 2012/0124994 A1 May 24, 2012

(51) Int. Cl.
*F04D 29/28* (2006.01)
*F04D 29/02* (2006.01)

(52) U.S. Cl.
USPC ..... 415/206; 416/223 R

(58) Field of Classification Search
None
See application file for complete search history.

(56) References Cited

U.S. PATENT DOCUMENTS 4,465,434 A * 8/1984 Rourk ..... 416/230
4,850,802 A * 7/1989 Pankratz et al. ..... 416/213 R
5,509,781 A 4/1996 Boszor et al.
5,605,441 A * 2/1997 Boszor et al. ..... 415/200
6,145,314 A 11/2000 Woollenweber et al.
7,648,759 B2 1/2010 Hirawaki et al.
2007/0101715 A1 5/2007 Martin et al.
2007/0297905 A1 12/2007 Muller
2011/0182743 A1* 7/2011 Naik ..... 416/230
2011/0299994 A1* 12/2011 Behnisch et al. ..... 416/230

FOREIGN PATENT DOCUMENTS

WO WO2010086268 A2 8/2010

OTHER PUBLICATIONS

CN Office Action issued Dec. 3, 2013 for corresponding CN Application No. 201110375534.9 (9 pages).

* cited by examiner

*Primary Examiner* — Nathaniel Wiehe
*Assistant Examiner* — Jeffrey A Brownson
(74) *Attorney, Agent, or Firm* — Cantor Colburn LLP

(57) ABSTRACT

A centrifugal compressor wheel for a turbocharger is disclosed. The wheel includes an axially extending hub having an inlet end, an outlet end, an arcuate outer surface and a shaft bore. The wheel also includes a blade array disposed on the outer surface of the hub, the blade array comprising a plurality of circumferentially-spaced, radially and axially extending, arcuate centrifugal impeller blades disposed thereon; the hub and the blade array comprising a non-woven, discontinuous-fiber-filled, polymer matrix composite material.

20 Claims, 3 Drawing Sheets

COMPOSITE CENTRIFUGAL COMPRESSOR WHEEL

FIELD OF THE INVENTION

Exemplary embodiments of the present invention are related to a centrifugal compressor wheel for use in a compressor, and more particularly to a composite centrifugal compressor wheel for use in a compressor of a turbocharger.

BACKGROUND

Centrifugal compressors are used in turbochargers, superchargers, and the like. They comprise a centrifugal compressor wheel that includes an array of aerodynamically contoured impeller blades supported by a central hub section. The hub is mounted on a rotatable driven shaft that is driven, in the case of a turbocharger, by the turbine wheel. For turbochargers, the hub section generally includes a central axial bore into which the shaft extends and is fastened to the hub. Fastening can take any suitable form, such as the use of a threaded shaft and hub, a keyed hub or, alternately, a nose of the shaft may extend through the hub and be fastened thereto using a nut to tighten the hub against a shoulder or other diametrically enlarged structure rotatable with the shaft. The shaft thereby rotatably drives the centrifugal compressor wheel in a direction such that the contoured blades axially draw in air and discharge that air radially outwardly at an elevated pressure level into a chamber of a compressor housing. The pressurized air is then supplied from the chamber to the air intake manifold of an internal combustion engine for admixture and combustion with fuel, all in a well-known manner.

Improvements in compressor technology and design have resulted in increased compressor efficiencies, flow ranges and rapid transient response by careful design of the compressors, particularly the centrifugal compressor wheels. For example, the impeller blades include compound and highly complex curvatures designed to optimize operational efficiency and flow range. The complex blade shapes are generally formed by casting a lightweight metal alloy, including various aluminum alloys, chosen for their relatively low density, to lower the rotational inertia and provide rapid response during transient operating conditions.

While effective, cast centrifugal compressor wheels of this type are subject to metal fatigue that limits the operating lifetime of the turbocharger. For example, a centrifugal compressor wheel may be rotated at operating speeds up to about 100,000 rpm or more. This leads to relatively high radial tensile loading; particularly in the hub portion of the wheel which must support the radial wheel mass. This radial tensile loading is also cyclic in nature during the startup and operation of the internal combustion engine, and the vehicle in the case of a mobile application, into which the turbocharger is incorporated. As the hub is cyclically stressed, inclusions, voids and other defects associated with the casting process provide stress risers resulting in fatigue processes that limit the operational life of the wheels and turbochargers that incorporate them. The use of forged or wrought materials to improve the operational lifetimes of the alloys is possible, but has generally not been sufficiently economical due to the cost of the machining required to form the complex shapes associates with the hub and blades.

Accordingly, centrifugal compressor wheels that provide the required performance characteristics, including high strength and low rotational inertia, as well as reduced susceptibility to fatigue processes compared to cast wheels are very desirable.

SUMMARY OF THE INVENTION

In an exemplary embodiment of the present invention, a centrifugal compressor wheel for a rotatable compressor is disclosed. The centrifugal compressor wheel includes an axially extending hub having an inlet end, an outlet end, an arcuate outer surface and a shaft bore. The centrifugal compressor wheel also includes a blade array disposed on the arcuate outer surface of the axially extending hub, the blade array comprising a plurality of circumferentially-spaced, radially and axially extending, arcuate centrifugal impeller blades disposed thereon; the axially extending hub and the blade array comprising a non-woven, discontinuous-fiber-filled, polymer matrix composite material.

The above features and advantages and other features and advantages of the present invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
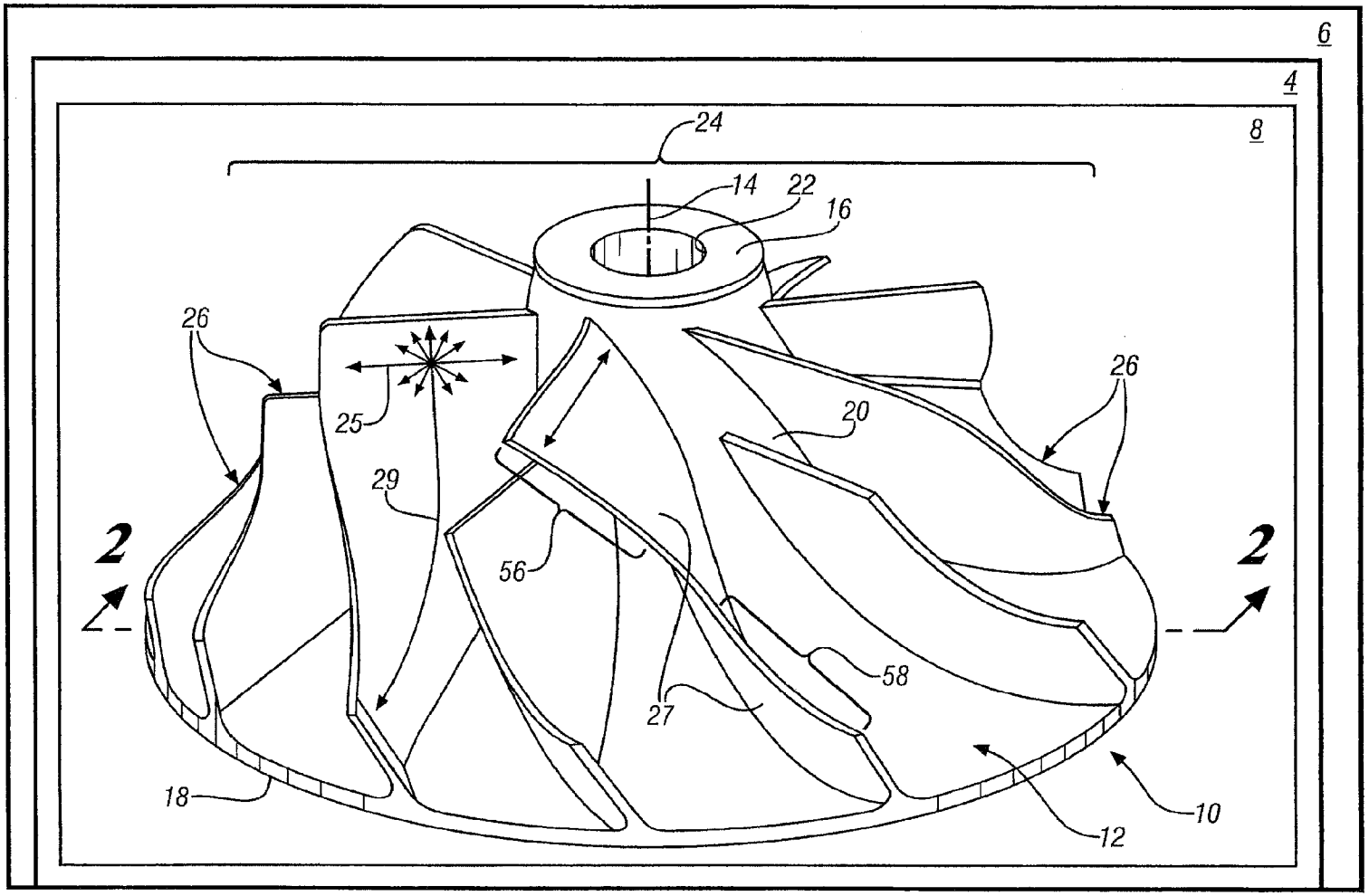
FIG. 1 is a schematic perspective view of an exemplary embodiment of a composite centrifugal compressor wheel as disclosed herein.

The following description is merely exemplary in nature and is not intended to limit the present disclosure, its application or uses. It should be understood that throughout the drawings, corresponding reference numerals indicate like or corresponding parts and features.

In accordance with exemplary embodiments of the present invention, as illustrated in FIGS. 1-4, a centrifugal centrifugal compressor wheel 10 for use as a centrifugal impeller in a rotatable compressor 8 is disclosed. Centrifugal compressor wheel 10 is suitable for use as a centrifugal impeller in many rotatable compressor 8 applications, including compressors 8 for various exhaust driven turbochargers 4 or the like, for internal combustion engines 6.

Centrifugal compressor wheel 10 includes an axially extending hub 12 that extends along a longitudinal axis 14. Axially extending hub 12 has an inlet end 16, an outlet end 18, an arcuate outer surface 20 and a shaft bore 22 and is configured for detachable attachment to, and engagement with, a rotatable shaft (not shown), such as a turbine shaft of a turbocharger, which is received into shaft bore 22 from the outlet end 18. The centrifugal compressor wheel 10 also includes a blade array 24, FIG. 1, disposed on the arcuate outer surface 20 of the axially extending hub 12. The blade array 24 includes a plurality of circumferentially-spaced, radially and axially extending, arcuate centrifugal impeller blades ("impeller blades") 26. Any suitable number of impeller blades 26 may be utilized in blade array 24 depending on the design requirements of centrifugal compressor wheel 10. Impeller blades 26 may have any suitable circumferential spacing(s). Similarly, impeller blades 26 may extend radially and axially to any desired extent and have any suitable shape, particularly of the blade surfaces 27. The impeller blades 26 comprise airfoils, and the blade surfaces 27 comprise airfoil surfaces. In an exemplary embodiment, the shape of the impeller blades 26 may be described by a plurality of connected chords that project outwardly from the outer surface 20 of the axially extending hub 12 in a chordal direction 25, FIG. 1. As used herein, a chord or chordal direction 25 is used to refer to a line segment joining two points of a curve and comprises the width of the impeller blades 26, or in the context of the impeller blades 26 as airfoils, a straight line segment connecting the leading and trailing edges of an airfoil section. A direction generally transverse to chordal direction 25 may be defined as transchordal direction 29 and generally extends along the length of the impeller blades, FIG. 1. The blade array 24 may be disposed on the arcuate outer surface 20 of the hub 12 by any suitable means or method, but will preferably be formed together with axially extending hub 12 so that the hub 12 and blade array 24 comprise an integral component without the use of a separately formed joint or the use of a separate joining method to join them. The specific impeller blade contouring typically includes a forward blade rake 56 generally adjacent to the inlet end 16 for at least some of the impeller blades 14, as illustrated in FIG. 1 and at least some backward curvature 58 near the periphery of the arcuate outer surface 20 of the axially extending hub 12.

Figure 2:
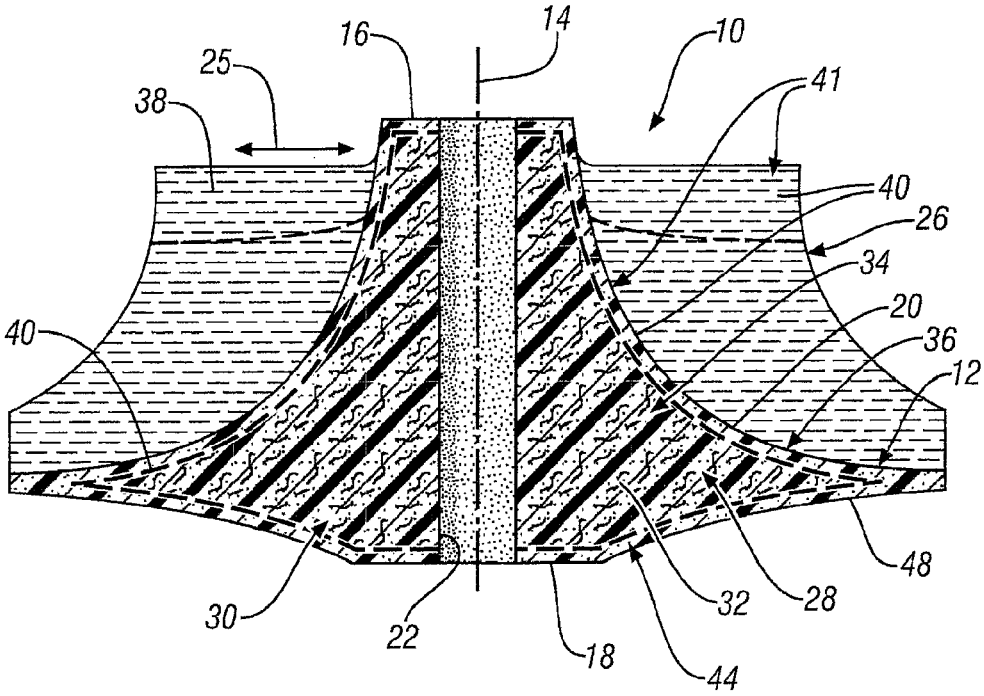
FIG. 2 is a cross-sectional view of the composite centrifugal compressor wheel of FIG. 1 taken along Section 2-2.
Figure 3:
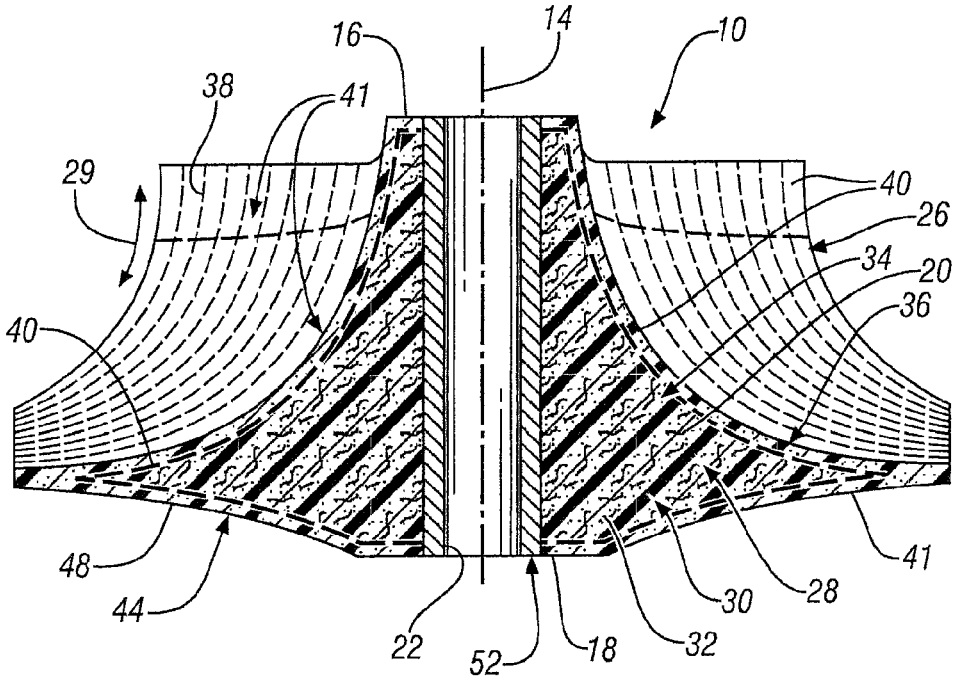
FIG. 3 is a cross-sectional view of a second exemplary embodiment of a composite centrifugal compressor wheel as disclosed herein.
Figure 4:
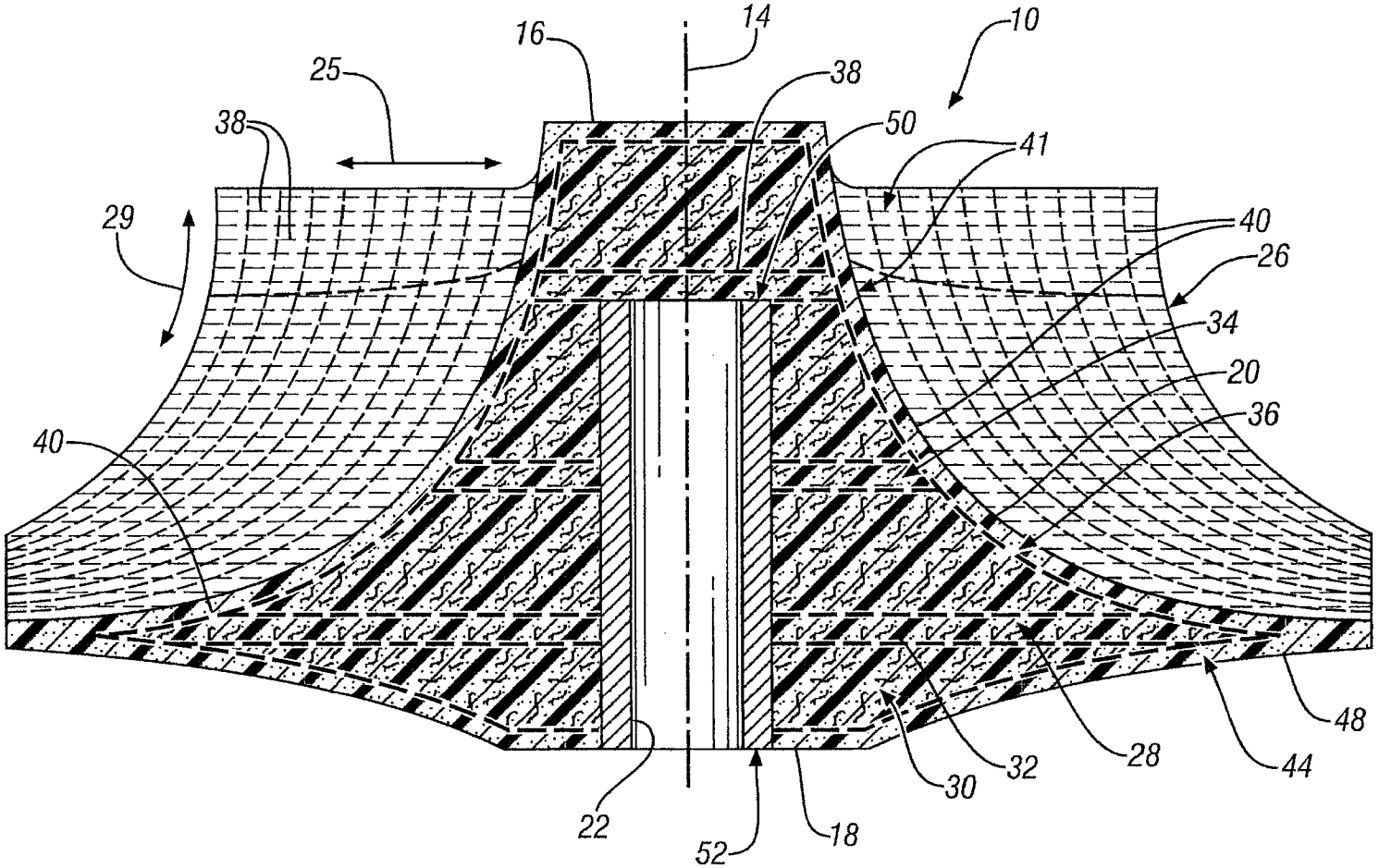
FIG. 4 is a cross-sectional view of a third exemplary embodiment of the composite centrifugal compressor wheel as disclosed herein.

The axially extending hub 12 and the blade array 24 are formed from a non-woven, discontinuous, fiber-filled, polymer matrix composite material 28. ("composite material"). The polymer matrix composite material 28 may comprise any suitable polymer matrix composite material 28, including a thermoplastic or thermoset polymer matrix 30. In an exemplary embodiment, polymer matrix 30 may include an epoxy, phenolic, polyimide, polyamide, polypropylene or polyether ether ketone resin. The polymer matrix 30 includes a plurality of non-woven, discontinuous fibers 32 as a dispersed reinforcing filler material providing a strengthening phase to reinforce the polymer matrix, as illustrated in FIGS. 2-4. Polymer matrix 30 may also include other suitable filler materials, including various organic and inorganic particulate filler materials, and more particularly filler materials comprising various nanoparticle filler materials, including carbon nanoparticles, such as various types of carbon nanotubes. Polymer matrix composite material 28 may include polymer matrix 30 and fibers 32 in any suitable relative amounts. In an exemplary embodiment, the amount of fibers 32 will be as large as possible while still providing a mixture that may be formed into the desired shape of centrifugal compressor wheel 10 in order to provide the maximum amount or loading of fibers 32 within the polymer matrix 30. Fibers 32 may be dispersed in polymer matrix 30 in any suitable manner, including as a homogeneous or heterogeneous dispersion.

Fibers 32 may be formed from any suitable non-woven, discontinuous fiber material, including various metal, glass, polymer or carbon fibers, or a combination thereof. Fibers 32 may have any suitable fiber characteristic, including length, cross-sectional shape and cross-sectional size (e.g., fiber diameter for a cylindrical fiber), and may include a mixture of non-woven, discontinuous fibers having different characteristics. The fibers 32 may include individual filaments, tows or untwisted bundles of discontinuous (e.g., chopped) filaments or yarns.

Centrifugal compressor wheel 10 may be formed by any suitable method of forming, but will preferably be formed by methods that provide the wheel as an integral component, as described herein. In an exemplary embodiment, centrifugal compressor wheel 10 may be molded. Molding may be performed using any suitable method including open mold methods, such as spray up, or closed mold methods, such as compression molding, transfer molding or injection molding. The fiber resin polymer composite molding compounds comprise a resin matrix with short randomly dispersed fibers 32, similar to those used in plastic molding. In an exemplary embodiment, the molding compound for composite processing includes thermosetting polymers. Since they are designed for molding, they must be capable of flowing in the mold. Accordingly, they generally are not cured or polymerized prior to shape processing. Curing is done during or after final shaping, or both, and may include curing at room temperature or elevated temperatures, including heating in an autoclave.

The centrifugal compressor wheel 10 described herein is formed substantially from a core 34, that includes both the core portions of the impeller blades 26 and the axially extending hub 12 that are formed of the non-woven, discontinuous, fiber-filled, polymer matrix composite material. However, in another exemplary embodiment, the use of continuous or semi-continuous fibers in any form, whether as individual filaments, rovings or yarns, and including in various fabrics or felts may also be used in conjunction with the core 34.

In an exemplary embodiment, the impeller blades 26 and axially extending hub 12 include an outer layer 36 of continuous or semi-continuous fibers 38 disposed on the core 34 that comprises the non-woven, discontinuous-fiber-filled, polymer matrix composite material 28. The continuous or semi-continuous fibers 38 may include any suitable fibers, including metal, glass, polymer or carbon fibers, or a combination thereof. Outer layer 36 may serve to strengthen or stiffen the outer surface 41 of centrifugal compressor wheel 10. Outer layer 36 may be disposed on an outer surface 40 of the core 34 of the centrifugal compressor wheel 10. The outer surface 40 may include blade surfaces 27 or the non-blade outer surface 41 of the axially extending hub 20, or a combination thereof. Outer layer 36 need not be at the outer surface 41 of centrifugal compressor wheel 10, but may also be proximate the outer surface 41 and will preferably be impregnated by and embedded within polymer matrix 30. The continuous or semi-continuous fibers 38 may be applied in any suitable directional orientation or pattern over outer surfaces 40 as described herein. In an exemplary embodiment, the layer of continuous or semi-continuous fibers 38 includes a plurality of fiber tows or rovings oriented in a first direction. The first direction may be in a substantially chordal direction 25, FIG. 2, or a substantially transchordal direction 29, FIG. 3. In another exemplary embodiment, the layer of continuous or semi-continuous fibers 38 includes a first plurality of fibers, including filaments, rovings, or yarns, or a combination thereof, oriented in a first direction and a second plurality of fibers, including filaments, rovings, or yarns, or a combination thereof, oriented in a second direction. For example, the first direction may include a chordal direction 25 and the second direction may include a transchordal direction 29. Any combination of chordal or transchordal arrangements of continuous or semi-continuous fibers 38 may be used for outer layer 36. The continuous or semi-continuous fibers 38 may also be oriented in other directions, including directions biased in varying degrees from chordal 25 and transchordal 29 directions.

In another exemplary embodiment, the axially extending hub 12 includes a base layer 44 of continuous or semi-continuous fibers 38 disposed on core 34 comprising a non-woven, discontinuous-fiber-filled, polymer matrix composite material 28. Base layer 44 may serve to strengthen or stiffen the base surface 48 of centrifugal compressor wheel 10. Base surface 48 may be disposed on the base layer 44 of the core 34 proximate the outlet end 18. Base surface 48 need not be integral with the base surface 48 of centrifugal compressor wheel 10, but may also be proximate the base surface 48 and will preferably be impregnated by and embedded within polymer matrix 30. Any combination of arrangements of continuous or semi-continuous fibers 38 may be used for base layer 44. The fibers 38 may, for example, be oriented radially or circumferentially, or a combination thereof, or in other directions, including directions biased in varying degrees from radial and circumferential directions. The continuous or semi-continuous fibers 38 may be applied in any suitable directional orientation or pattern over base layer 44, as described herein. The continuous or semi-continuous fibers 38 of outer layer 36 and base layer 44 may be coextensive to any extent, including fibers extending continuously between layers or overlapping in any overlapped arrangement, or may be non-coextensive (i.e., two separate layers).

The outer layer 36, the base layer 44 or both, may include continuous or semi-continuous fibers 38 formed as a woven fabric or cloth. A fabric used for outer layer 36, for example, may include woven fibers 38 oriented in a first and second direction, where the first direction comprises a chordal direction 25 and the second direction comprises a transchordal direction 29, or vice versa. The most familiar form of continuous fiber is a cloth or a fabric of woven yarns. Similar to a cloth is a woven roving or tow, a fabric consisting of untwisted filaments rather than yarns. Woven rovings can be produced with unequal numbers of strands in the two directions so that they possess greater strength in one direction. Such unidirectional woven rovings are often preferred in laminated fiber reinforced polymer composites. The continuous or semi-continuous fibers 38 can also be in a mat form such as a felt consisting of randomly oriented short fibers held loosely together with a binder. Mats are commercially available as blankets of various weights, thicknesses, and widths. Mats can be cut and shaped for use as preforms in some of the closed mold processes. During molding, the resin impregnates the preform and then cures to define outer layer 36 or base layer 44.

The core 34 may also include at least one inner layer 50 comprising continuous or semi-continuous fibers 38 that are arranged substantially transverse to the longitudinal axis 14 and shaft bore 22, FIG. 4. Inner layer 50 may also include a plurality of layers 50. Inner layer 50 strengthens and stiffens centrifugal compressor 10, particularly axially extending hub 12. Inner layer 50 may be formed from continuous or semi-continuous fibers 38 in the same manner as outer layer 36 or base layer 44. Fibers 38 may, for example, be oriented radially or circumferentially, or a combination thereof, or in other directions, including directions biased in varying degrees from radial and circumferential directions. The fibers 38 may also include a woven roving or fabric.

The centrifugal compressor wheel 10 also includes shaft bore 22. Shaft bore 22 may extend completely, FIGS. 1-3, or partially, FIG. 4, through the axially extending hub 12. Shaft bore 22 may be sized to receive a driven shaft (not shown). Centrifugal compressor wheel 10 may also include a shaft bore insert 52. Shaft bore insert 52 strengthens shaft bore 22. In certain embodiments, shaft bore insert may also be threaded to engage a threaded driven shaft (not shown), such as a turbine shaft. Shaft bore insert 52 may include any suitable insert material. In an exemplary embodiment, shaft bore insert 52 may include a metal, such as aluminum or an aluminum alloy. Shaft bore insert 52 may extend contiguously with shaft bore 22, or may extend only partially within shaft bore 22. Likewise, shaft bore insert 52 may extend further along longitudinal axis 14 than shaft bore 22. The construction described provides a centrifugal compressor wheel 10 which is light in weight and has a relatively low rotational inertia for rapid operational response to transient conditions.

The composite centrifugal compressor wheel 10 of this invention may provide substantial improvements in fatigue life over conventional centrifugal compressor wheels of the type used in turbochargers, superchargers, and the like, without sacrificing efficiency and flow range in accordance with a preferred aerodynamic contouring of the impeller blades 26. This blade contouring includes complex and compound blade curvatures which effectively prohibit manufacture of the blades by any means other than a molding process. Alternately stated, this complex blade contouring renders other forming techniques, such as forging, machining, and the like, impossible or economically unfeasible. Accordingly, in the past, centrifugal compressor wheels for turbochargers have been formed from a unitary casting wherein the blades are cast integrally with a wheel hub through which a central axial bore is formed as by drilling to permit mounting onto the rotating shaft of a turbocharger or the like, all in a well-known manner. To minimize rotational inertia of the centrifugal compressor wheel and thereby achieve a desired rapid response to transient operating conditions, the cast wheel is normally formed from aluminum or a lightweight aluminum alloy.

When the centrifugal compressor wheel 10 is rotated, each internal increment thereof is subjected to a radial tensile loading which varies in magnitude in accordance with the rotational speed of the wheel, and further in accordance with the wheel mass disposed radially outwardly from that increment. The present invention provides a substantially improved centrifugal centrifugal compressor wheel 10 by forming high stress regions of the axially extending hub 12 from polymer matrix material 30 filled with non-woven, discontinuous fibers 32.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A exhaust driven turbocharger, for an internal combustion engine, having a centrifugal compressor, comprising:

an axially extending hub having an inlet end, an outlet end, an arcuate outer surface and a shaft bore; and a blade array disposed on the arcuate outer surface of the axially extending hub, the blade array comprising a plurality of circumferentially-spaced, radially and axially extending, arcuate centrifugal impeller blades disposed thereon; where both the axially extending hub and the blade array each comprise a non-woven, discontinuous-fiber-filled, polymer matrix composite material.

2. The exhaust driven turbocharger of claim 1, wherein the non-woven, discontinuous, fiber-filled, polymer matrix composite material comprises metal, glass, polymer or carbon fiber, or a combination thereof.

3. The exhaust driven turbocharger of claim 2, wherein the non-woven, discontinuous, fiber-filled, polymer matrix composite material comprises an epoxy, phenolic, polyimide, polyamide, polypropylene, or polyether ether ketone resin.

4. The exhaust driven turbocharger of claim 1, wherein the impeller blades and the axially extending hub comprise an outer layer of continuous or semi-continuous fibers disposed on a core comprising the non-woven, discontinuous-fiber-filled, polymer matrix composite material.

5. The exhaust driven turbocharger of claim 4, wherein each impeller blade has a blade surface and an outer layer that is proximate to the blade surface and the axially extending hub surface.

6. The exhaust driven turbocharger of claim 5, wherein the axially extending hub also comprises a base surface proximate the outlet end, and wherein an outer layer is also proximate the base surface.

7. The exhaust driven turbocharger of claim 4, wherein the layer of continuous or semi-continuous fibers comprises a plurality of fiber tows oriented in a first direction.

8. The exhaust driven turbocharger of claim 7, wherein the first direction comprises a chordal direction.

9. The exhaust driven turbocharger of claim 7, wherein the first direction comprises a transchordal direction.

10. The exhaust driven turbocharger of claim 4, wherein the layer of continuous or semi-continuous fibers comprises a first plurality of fiber tows oriented in a first direction and a second plurality of fiber tows oriented in a second direction.

11. The exhaust driven turbocharger of claim 10, wherein the first direction comprises a chordal direction and the second direction comprises a transchordal direction.

12. The exhaust driven turbocharger of claim 10, wherein the layer of continuous or semi-continuous fibers comprises a woven fabric.

13. The exhaust driven turbocharger of claim 12, wherein the woven fabric comprises a first plurality of fiber tows oriented in a first direction interwoven with a second plurality of fiber tows oriented a second direction.

14. The exhaust driven turbocharger of claim 13, wherein the first direction comprises a chordal direction and the second direction comprises a transchordal direction.

15. The exhaust driven turbocharger of claim 10, wherein the first plurality of fiber tows and the second plurality of fiber tows comprise metal, glass, polymer or carbon fibers, or a combination thereof, and the polymer matrix comprises an epoxy, phenolic, polyimide, polyamide, polypropylene, or polyether ether ketone resin.

16. The exhaust driven turbocharger of claim 4, wherein the axially extending hub also comprises at least one inner layer, comprising continuous or semi-continuous fibers, that is arranged substantially transverse to the shaft bore.

17. The exhaust driven turbocharger of claim 1, wherein the shaft bore extends completely or partially through the axially extending hub.

18. The exhaust driven turbocharger of claim 1, further comprising a shaft bore insert.

19. A centrifugal compressor wheel for a rotatable compressor, comprising:

an axially extending hub having a inlet end, an outlet end, an arcuate outer surface and a shaft bore; and a blade array disposed on the arcuate outer surface of the axially extending hub, the blade array comprising a plurality of circumferentially-spaced, radially and axially extending, arcuate centrifugal impeller blades disposed thereon; where both the axially extending hub and the blade array each comprise a non-woven, discontinuous-fiber-filled, polymer matrix composite material.

20. The centrifugal compressor wheel of claim 19, wherein the non-woven, discontinuous, fiber-filled, polymer matrix composite material comprises metal, glass, polymer or carbon fiber, or a combination thereof and, wherein the non-woven, discontinuous, fiber-filled, polymer matrix composite material comprises an epoxy, phenolic, polyimide, polyamide, polypropylene, or polyether ether ketone resin and, wherein the impeller blades and the axially extending hub comprise an outer layer of continuous or semi-continuous fibers disposed on a core comprising the non-woven, discontinuous-fiber-filled, polymer matrix composite material.

* * * * *